US007586731B2

(12) United States Patent
Sato et al.

(10) Patent No.: US 7,586,731 B2
(45) Date of Patent: Sep. 8, 2009

(54) ION BALANCE ADJUSTING METHOD AND METHOD OF REMOVING CHARGES FROM WORKPIECE BY USING THE SAME

(75) Inventors: Toshio Sato, Tsukubamirai (JP); Satoshi Suzuki, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 286 days.

(21) Appl. No.: 11/562,211

(22) Filed: Nov. 21, 2006

(65) Prior Publication Data

US 2007/0133145 A1 Jun. 14, 2007

(30) Foreign Application Priority Data

Nov. 25, 2005 (JP) ..... 2005-340027

(51) Int. Cl.
*H05F 3/00* (2006.01)
*H01T 23/00* (2006.01)

(52) U.S. Cl. ..... 361/231

(58) Field of Classification Search ..... 361/231
See application file for complete search history.

(56) References Cited

U.S. PATENT DOCUMENTS 4,630,167 A * 12/1986 Huggins ..... 361/213
5,750,011 A * 5/1998 Ohmi et al. ..... 204/164
6,873,515 B2 * 3/2005 Chang ..... 361/213

FOREIGN PATENT DOCUMENTS

| | | |
|---|---|---|
| JP | 3-266398 | 11/1991 |
| JP | 6-203993 | 7/1994 |
| JP | 11-135293 | 5/1999 |
| JP | 2003-217892 | 7/2003 |

* cited by examiner

*Primary Examiner*—Ronald W Leja
(74) *Attorney, Agent, or Firm*—Oblon, Spivak, McClelland, Maier & Neustadt, P.C.

(57) ABSTRACT

When charges are removed from a charged workpiece by applying positive and negative pulse-like high voltages to positive and negative electrode needles to generate positive and negative ions in a charge removing area and feeding the charged workpiece into the charge removing area, an ion balance inside the charge removing area is measured by a surface potential sensor before the workpiece is fed into the charge removing area, and a pulse width and/or a voltage value of the pulse-like high voltage applied to the electrode needle is changed depending on a measured result, thereby adjusting an amount of ions generated from the electrode needle to take a balance between the positive and negative ions.

7 Claims, 2 Drawing Sheets

ION BALANCE ADJUSTING METHOD AND METHOD OF REMOVING CHARGES FROM WORKPIECE BY USING THE SAME

TECHNICAL FIELD

The present invention relates to an ion balance adjusting method for taking a balance between positive and negative ions released from an ionizer when charges are removed from a charged workpiece, and also relates to a method of removing charges from the workpiece by using the adjusting method.

BACKGROUND ART

In one known method of removing charges from an electrostatically charged workpiece, the charges are removed by releasing positive and negative ions from an ionizer toward the workpiece fed into a charge removing area, and neutralizing the positive or negative charges carried on the workpiece by the ions having the polarity opposite to that of the charges on the workpiece.

The ionizer generally has a positive electrode needle and a negative electrode needle. By applying a positive pulse-like high voltage to the positive electrode needle and applying a negative pulse-like high voltage to the negative electrode needle, corona discharge is produced to generate positive and negative ions from both the electrodes.

When charges are removed from a workpiece by using such an ionizer, efficiency of a charge removal process can be increased by releasing, corresponding to the polarity of the charges on the workpiece, a larger amount of ions which have the opposite polarity. Depending on the condition of the charge removal process, however, it is impossible to properly confirm in which one of positive and negative polarities is charged the workpiece. In view of that situation, therefore, the charge removal process is desirably adaptable for any case regardless of whether the fed workpiece is positively or negatively charged. One conceivable means for satisfying such a demand is to make pre-adjustment of positive and negative ions released from the ionizer so that an ion balanced state, i.e., a state of the positive and negative ions being substantially equal to each other in number, is obtained in advance. In that case, the pre-adjustment is required to be reliably carried out by simple means.

On the other hand, as one example of a method of adjusting an ion balance, Patent Document 1 discloses a technique of adjusting the ion balance by detecting a current, which flows through a ground line depending on the amount of positive and negative ions consumed when charges are removed from a workpiece, by a current sensor, and controlling positive and negative high-voltage generation circuits such that ions with the required polarity are generated in larger amount.

Also, Patent Document 2 discloses a technique of taking an ion balance by arranging a current detecting electrode between positive and negative electrode needles, detecting an ion current, which flows between both the electrode needles when charges are removed from a workpiece, by the current detecting electrode, and adjusting a voltage or pulse width, which is applied to the electrode needles, depending on the polarity of the ion current and the difference in ion amount.

However, because those disclosed techniques are each intended to take an ion balance by detecting the current flowing through the ground line or between both the electrode needles, any of those techniques cannot directly confirm whether positive and negative ions are actually well balanced. Further, if the current is changed due to some other factor than ions, there is a risk that a malfunction may occur and the ion balance may be lost in reverse. Thus, those techniques have a problem in reliability.

Further, Patent Document 3 discloses a technique of employing an electrostatic potential sensor for measuring an electrostatic potential of a charge removal target (workpiece) and an electrostatic potential sensor for measuring an ion balance around an ionizer, and adjusting the amount of ions released from the ionizer by using those two electrostatic potential sensors based on measured values of both the sensors during a process of removing charges from the workpiece. More specifically, during the first period of the charge removal process in which the charge potential of the workpiece is sufficiently high, ions with the polarity opposite to that of the charges are irradiated to quickly remove the charges from the workpiece. During the final period of the charge removal process in which the electrostatic potential of the workpiece is low, ions in the ion balanced state are irradiated to remove the charges from the workpiece.

According to the technique described above, however, because the polarity of the charges on the workpiece and the ion balance around the ionizer are measured by using the two electrostatic sensors and the amount of irradiated ions is controlled depending on the polarity of the charges on the workpiece, the construction and control of an apparatus are complicated. In addition, because the ion balance is measured during the process of removing charges from the workpiece, i.e., in the presence of the charged workpiece, and the amount of irradiated ions is controlled based on the measured result, an influence of the charged workpiece is caused as a disturbance, thus resulting in a difficulty in actually attaining the proper ion balance. Particularly, when charged workpieces are fed successively with short intervals, the adjustment of the ion balance is not finished in time and the charge removal process becomes hard to perform with reliability.

Patent Document 1: Japanese Unexamined Patent Application Publication No. 11-135293

Patent Document 2: Japanese Unexamined Patent Application Publication No. 3-266398

Patent Document 3: Japanese Unexamined Patent Application Publication No. 2003-217892

SUMMARY OF THE INVENTION

Accordingly, an object of the present invention is to provide simple and reliable technical means which can adjust positive and negative ions released from an ionizer into an ion balanced state, i.e., a state of the positive and negative ions being substantially equal to each other in number, with high accuracy prior to starting removal of charges from a workpiece.

To achieve the above object, the present invention provides an ion balance adjusting method using an ionizer for applying positive and negative pulse-like high voltages to positive and negative electrode needles, thereby producing corona discharge to generate positive and negative ions from the both electrode needles and removing charges from a workpiece, and a surface potential sensor for measuring an ion balance between the positive and negative ions, the method comprising the steps of measuring the ion balance between the positive and negative ions released from the ionizer by the surface potential sensor in the absence of the workpiece before removal of the charges from the workpiece is started, and changing a pulse width and/or a voltage value of the pulse-like high voltage applied to the electrode needle depending on a measured result, thereby adjusting an amount of ions generated from the electrode needle and taking a balance between the positive and negative ions.

In the present invention, the surface potential sensor includes a detection plate in integral form, which is charged upon contacting with the ions released from the ionizer, and the ion balance is measured based on a polarity of the charged detection plate.

Also, the present invention provides a method of removing charges from a workpiece by applying positive and negative pulse-like high voltages to positive and negative electrode needles of an ionizer, thereby producing corona discharge to generate positive and negative ions in a charge removing area, and feeding the charged workpiece into the charge removing area by a conveying apparatus to remove the charges from the workpiece, the method comprising the steps of measuring an ion balance inside the charge removing area by a surface potential sensor before the workpiece is fed into the charge removing area, changing a pulse width and/or a voltage value of the pulse-like high voltage applied to the electrode needle depending on a measured result, thereby adjusting an amount of ions generated from the electrode needle to adjust the ion balance between the positive and negative ions, and then feeding the workpiece into the charge removing area to remove the charges from the workpiece.

In the present invention, preferably, the adjustment of the ion balance is preferably performed in linkage with operation of the conveying apparatus.

Also, in the present invention, the adjustment of the ion balance is preferably performed whenever the workpiece in number corresponding to one process unit has been subjected to a charge removal process.

Further, in the present invention, the surface potential sensor includes a detection plate in integral form, which is charged upon contacting with the ions released from the ionizer, and the ion balance is measured based on a polarity of the charged detection plate.

Accordingly to the present invention described above, since the ion balance is measured in the absence of the workpiece and is properly adjusted, the positive and negative ions released from the ionizer can be reliably adjusted into an ion balanced state prior to starting the removal of the charges from the workpiece without suffering from an influence of the charged workpiece, i.e., without being affected by a disturbance.

BEST MODE FOR CARRYING OUT THE INVENTION

Figure 1:
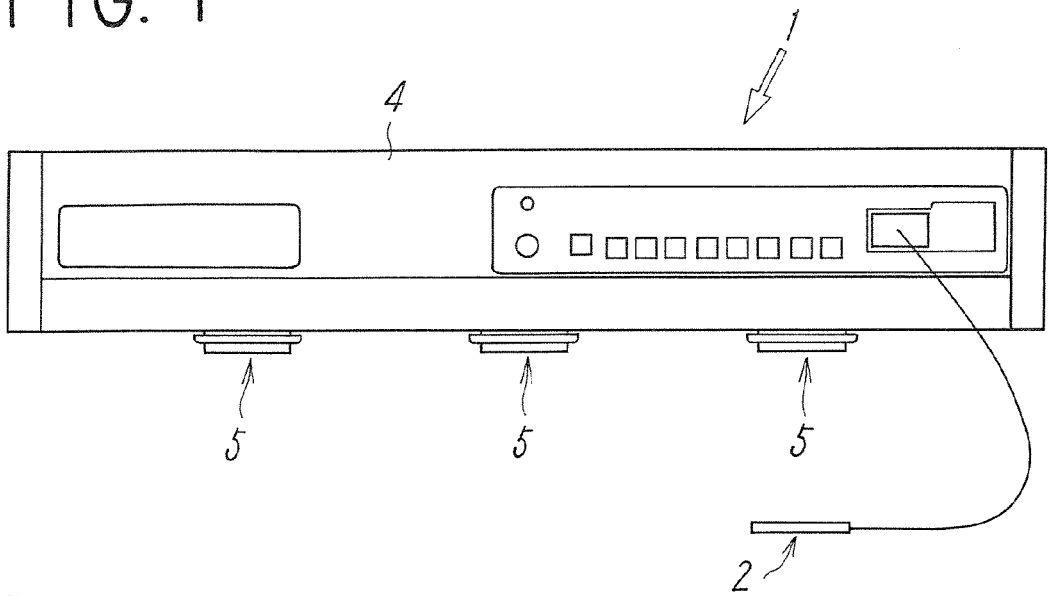
FIG. 1 is a view showing the construction of a charge removing apparatus used for carrying out a method according to the present invention.

FIG. 1 shows a charge removing apparatus used for carrying out a method according to the present invention. In FIG. 1, reference numeral 1 denotes ionizer for releasing positive and negative ions, and 2 denotes a surface potential sensor for measuring an ion balance between the positive and negative ions released from the ionizer 1.

Figure 4:
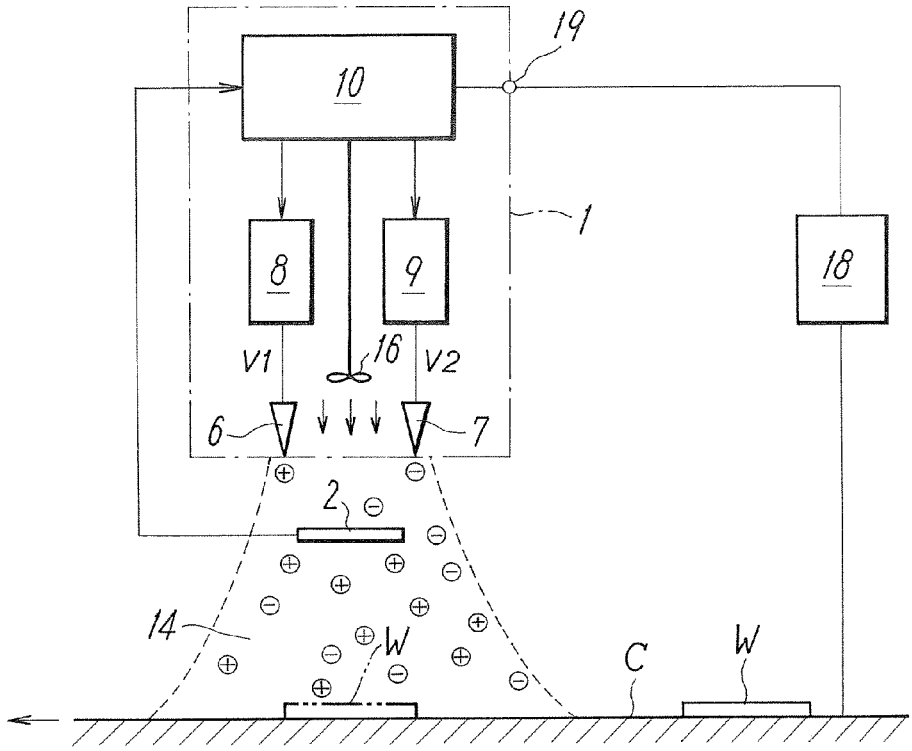
FIG. 4 is a conceptual illustration showing a state of adjusting an ion balance.

As illustrated in FIG. 4, the ionizer 1 is disposed to face a conveying apparatus C, e.g., a conveyor, for conveying a charged workpiece W. The ionizer releases the positive and negative ions into a charge removing area 14, to thereby remove charges from the workpiece W. In FIG. 4, reference numeral 18 denotes a conveyance controller for operating and controlling the conveying apparatus C.

Figure 2:
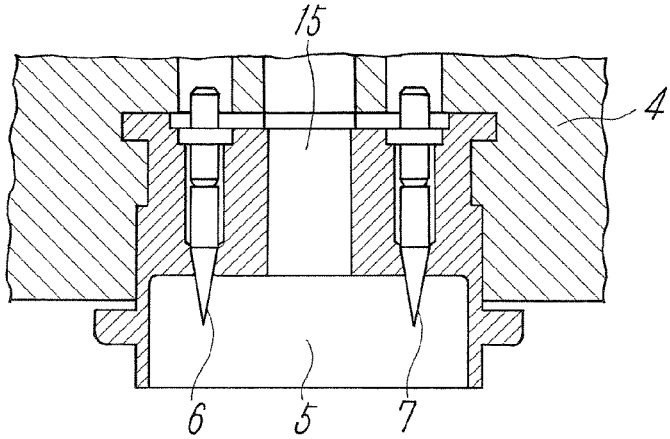
FIG. 2 is an enlarged sectional view of a principal part of FIG. 1.

The ionizer 1 has a plurality of ion release ports 5 formed in a housing 4. As seen from FIGS. 2 and 4, a positive electrode needle 6 and a negative electrode needle 7 are disposed in each of the ion release ports 5. Further, a positive high-voltage generation circuit 8 for generating a positive pulse-like high voltage, a negative high-voltage generation circuit 9 for generating a negative pulse-like high voltage, and a controller 10 for controlling those high-voltage generation circuits 8 and 9 are incorporated in the housing 4. The positive high-voltage generation circuit 8 is connected to the positive electrode needle 6, and the negative high-voltage generation circuit 9 is connected to the negative electrode needle 7.

Figure 5:
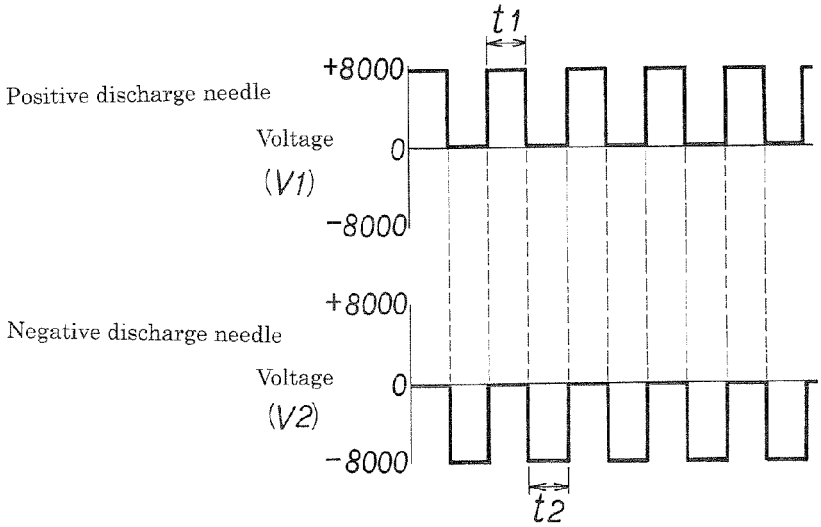
FIG. 5 is a graph showing the waveform of a pulse-like high voltage applied to each electrode needle.

The controller 10 alternately operates the high-voltage generation circuits 8 and 9 at a cycle of, e.g., about several tens Hz such that the high-voltage generation circuits 8 and 9 alternately generate a positive pulse-like high voltage V1 with a pulse width t1 and a negative pulse-like high voltage V2 with a pulse width t2, respectively, as shown in FIG. 5. The positive pulse-like high voltage V1 is applied to the positive electrode needle 6, and the negative pulse-like high voltage V2 is applied to the negative electrode needle 7. As a result, corona discharge is produced at each of the electrode needles 6 and 7, whereby positive ions are released from the positive electrode needle 6 and negative ions are released from the negative electrode needle 7. The pulse widths t1 and t2 are equal to each other in some cases and not equal to each other in other cases depending on the state to be controlled.

Voltage values of the positive and negative pulse-like high voltages V1 and V2 are set respectively to +8,000 V and −8,000 V in the shown example, but those voltages may be set to other suitable values.

In order that the positive and negative ions generated from the electrode needles 6 and 7 are uniformly and satisfactorily dispersed into the charge removing area 14, a blow port 15 is provided in each of the ion release ports 5 and a fan 16 (see FIG. 4) is disposed within the housing 4. The ions are delivered from the ion release ports 5 into the charge removing area 14 with air sent from the fan 16.

Figure 3:
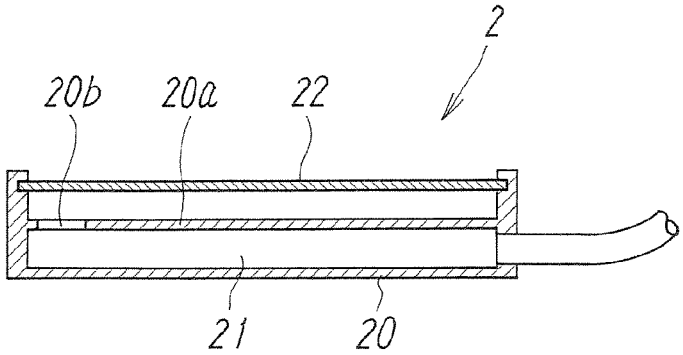
FIG. 3 is a sectional view of a surface potential sensor.

As shown in FIG. 3, the surface potential sensor 2 comprises a sensor housing 20 in the form of a container, a sensor body 21 installed within the sensor housing 20, and a metal-made detection plate 22 attached so as to cover an opening at an upper side of the sensor housing 20. The detection plate 22 is charged upon contacting with the ions released from the ionizer 1 and generates lines of electric force depending on the polarity and the amount of resultant charges. More specifically, when the amount of the positive ions is relatively large, the detection plate 22 is charged to be positive, and when the amount of the negative ions is relatively large, the detection plate 22 is charged to be negative. Also, when the positive and negative ions are balanced, the detection plate 22 is not charged in any polarity. A partition 20*a* covering the sensor body 21 is interposed between the detection plate 22 and the sensor body 21, and a window hole 20*b* is formed in a part of the partition 20*a*. The lines of electric force generated by the detection plate 22 are detected by the sensor body 21 through the window hole 20*b*.

The surface potential sensor 2 may be disposed in any position and any orientation within the charge removing area 14. However, the detection plate 22 is preferably disposed in orientation to face the ionizer 1, as shown in FIG. 4, so that the positive and negative ions released from the ionizer 1 can be accurately measured.

When the charges are removed from the charged workpiece W by using the above-described charge removing apparatus, an ion balance between the positive and negative ions released from the ionizer 1 is measured by the surface potential sensor 2 in a state where the workpiece W is excluded from FIG. 4 to be not present, i.e., in a stage before the workpiece W is fed into the charge removing area 14 by the conveying apparatus C.

Measured data from the sensor body 21 is fed back to the controller 10, and the controller 10 controls the high-voltage generation circuits 8 and 9 so as to perform operation for reducing the amount of the released ions with the same polarity as that of the charged detection plate 22 by shortening the pulse width of the pulse-like high voltage which is applied to the electrode needle corresponding to the detected polarity. More specifically, when the polarity of the charged detection plate 22 is positive, the pulse width t1 of the pulse-like high voltage V1 applied to the positive electrode needle 6 is shortened to reduce the amount of the released positive ions, and when the polarity of the charged detection plate 22 is negative, the pulse width t2 of the pulse-like high voltage V2 applied to the negative electrode needle 7 is shortened to reduce the amount of the released negative ions. That operation is repeated until the positive and negative ions are balanced. On that occasion, the degree at which the pulse width t1 or t2 is shortened can be adjusted depending on the amount of the charges detected by the detection plate 22.

As a result, the proper ion balance between the positive and negative ions inside the charge removing area 14 is attained. After the proper ion balance has been attained, the controller 10 can make the pulse widths t1 and t2 of the positive and negative pulse-like high voltages V1 and V2 kept in the state at that time. Alternatively, the controller 10 may be continuously held in the state capable of adjusting the pulse widths.

Thus, by measuring the ion balance in the absence of the workpiece W and properly adjusting the ion balance, the positive and negative ions released from the ionizer 1 can be reliably adjusted into the ion balanced state prior to starting the removal of the charges from the workpiece without suffering from an influence of the charged workpiece W, i.e., without being affected by a disturbance.

When the adjustment of the ion balance inside the charge removing area 14 is completed, the workpiece W is conveyed by the conveying apparatus C into the charge removing area 14 where the charges are removed from the workpiece W. At that time, when the workpiece W is positively charged, the charges are removed by adsorbing the negative ions, and when the workpiece W is negatively charged, the charges are removed by adsorbing the positive ions. The workpiece W from which have been removed the charges is conveyed out of the charge removing area 14.

After removing the charges from the workpiece W, the ion balance inside the charge removing area 14 comes into an unbalanced state again. Accordingly, before the next workpiece W is fed into the charge removing area 14 by the conveying apparatus C, the operation for attaining the proper ion balance is performed again by changing the pulse widths t1 and t2 of the positive and negative pulse-like high voltages V1 and V2, thereby adjusting the ion amounts. That operation is repeated whenever the process of removing the charges from the workpiece is performed.

The number of workpieces W subjected to the charge removing process at a time is not limited to one, but it may be plural. In other words, the charge removing process is performed while one or a plurality of workpieces is set as one process unit (one batch).

To ensure that the ion balance is reliably adjusted before the workpiece W is fed into the charge removing area 14, the adjustment of the ion balance and the conveyance of the workpiece by the conveying apparatus C are desirably performed in a correlated manner. For that purpose, the controller 10 and the conveyance controller 18 are electrically connected to each other via a signal terminal 19 such that signals in both the controllers can be mutually utilized for the adjustment of the ion balance and the operation control of the conveying apparatus C.

Thus, correlated control can be set, by way of example, as follows. When the conveying apparatus C is turned on (started up) to remove the charges from the workpiece W, or when the conveying apparatus C is turned off (stopped) after removing the charges from the workpieces in one process unit, or when speed control (e.g., slowdown control) of the conveying apparatus C is performed to adjust the timing of feeding the workpiece W into the charge removing area 14, a signal indicating the relevant situation can be inputted to the controller 10 such that the adjustment of the ion balance can be automatically performed.

Also, when a certain time has lapsed after the conveying apparatus C has been brought into an operational state corresponding to the adjustment of the ion balance, or when an end-of-adjustment signal indicating the end of the adjustment of the ion balance is inputted from the controller 10 to the conveyance controller 18, the operational state of the conveying apparatus C can be switched over to the ordinary conveying state such that the workpiece W is fed into the charge removing area 14.

Further, during a period in which the adjustment of the ion balance is performed, a signal indicating the state under the adjustment can be outputted from the controller 10 and, in response to that signal, the conveying apparatus C can be maintained in the off-state or the slowdown state. By utilizing that signal to operate an indicator, e.g., a lamp or a buzzer, at the same time, a worker can be informed of the state under the adjustment of the ion balance.

Instead of enabling the ion balance to be adjusted in linkage with the operational state of the conveying apparatus C as described above, the operational state of the conveying apparatus C can be controlled in linkage with the adjustment of the ion balance in such a manner that, when the worker sets the ionizer 1 into operation and starts the adjustment of the ion balance by manually operating a switch disposed on the controller 10 or operating a remote control unit, a start signal is sent from the controller 10 to the conveyance controller 18 to turn off or slow down the conveying apparatus C.

In the above-described embodiment, the adjustment of the ion balance is performed, in order to reduce the amount of the released ions with the same polarity as that of the charged detection plate 22 of the surface potential sensor 2, by shortening the pulse width t1 or t2 of the pulse-like high voltage V1 or V2 which is applied to the electrode needle 6 or 7 corresponding to the detected polarity. However, the pulse width t1 or t2 of the pulse-like high voltage V1 or V2 applied to the corresponding electrode needle 6 or 7 may be enlarged in order to increase the amount of the released ions with the polarity opposite to that of the charged detection plate 22.

Further, a voltage value of the pulse-like high voltage V1 or V2 can be changed instead of changing the pulse width t1 or t2 as described above, or in addition to changing the pulse width t1 or t2. In that case, the amount by which the voltage value is changed can be adjusted depending on the amount of the charges detected by the detection plate 22.

The invention claimed is:

1. A method of removing charges from a workpiece by applying positive and negative pulse-like high voltages to positive and negative electrode needles of an ionizer, thereby producing corona discharge to generate positive and negative ions in a charge removing area, and intermittently feeding the charged workpiece into said charge removing area by a conveying apparatus to remove the charges from said workpiece, the method comprising:

measuring an ion balance inside the charge removing area by a surface potential sensor in the absence of the workpiece before said workpiece is fed into said charge removing area;

changing a pulse width of a positive side or negative side pulse-like high voltage applied to said electrode needle depending on a measured result, thereby adjusting an amount of positive or negative ions generated from said electrode needle to maintain a previous balance between the positive and negative ions in the charge removing area; and then feeding said workpiece into said charge removing area to remove the charges from said workpiece.

2. The charge removing method according to claim 1, wherein a controller for controlling the pulse-like high voltage and a conveyance controller for controlling the conveying apparatus can transmit and receive mutual signals to perform the adjustment of the ion balance in linkage with operation of said conveying apparatus, by signals transmitted from the controller to the conveyance controller, wherein the feed of the workpiece into the charge removing area by the conveying apparatus is not performed when the adjustment of the ion balance is performed, and the feed of the workpiece into the charge removing area by the conveying apparatus becomes possible to be performed when the adjustment of the ion balance finishes.

3. The charge removing method according to claim 2, wherein the adjustment of the ion balance is performed whenever the workpiece in number corresponding to one process unit has been subjected to a charge removal process.

4. The charge removing method according to claim 2, wherein said surface potential sensor includes a detection plate which is charged upon contacting with the ions released from said ionizer, and the ion balance is measured based on a polarity of said charged detection plate.

5. The charge removing method according to claim 1, wherein the adjustment of the ion balance is performed whenever the workpiece in number corresponding to one process unit has been subjected to a charge removal process.

6. The charge removing method according to claim 5, wherein said surface potential sensor includes a detection plate which is charged upon contacting with the ions released from said ionizer, and the ion balance is measured based on a polarity of said charged detection plate.

7. The charge removing method according to claim 1, wherein said surface potential sensor includes a detection plate which is charged upon contacting with the ions released from said ionizer, and the ion balance is measured based on a polarity of said charged detection plate.

* * * * *